United States Patent [19]

Waterman

[11] Patent Number: 4,796,819

[45] Date of Patent: Jan. 10, 1989

[54] WOOD CHIPPER TO BE TRANSPORTED AND POWERED BY A TRACTOR

[76] Inventor: Carl D. Waterman, P.O. Box 349, Waldoboro, Me. 04572

[21] Appl. No.: 121,078

[22] Filed: Nov. 16, 1987

[51] Int. Cl.[4] ..... B02C 18/06

[52] U.S. Cl. ..... 241/92; 144/176; 180/53.3; 241/101.7; 241/292.1

[58] Field of Search ..... 241/92, 101.1, 101.2, 241/101.7, 278 R, 280, 282.2, 292.1, 298, 285 R; 144/176, 373; 180/53.3, 53.1

[56] References Cited

U.S. PATENT DOCUMENTS

| | | | |
|---|---|---|---|
| 2,544,025 | 3/1951 | Johnson | 55/61 |
| 2,712,842 | 7/1955 | Fahrni | 241/92 X |
| 3,335,771 | 8/1967 | Ledergerber | 241/92 X |
| 4,598,745 | 7/1986 | Parviainen | 241/92 X |

FOREIGN PATENT DOCUMENTS

| | | | |
|---|---|---|---|
| 176060 | 2/1953 | Fed. Rep. of Germany | 241/92 |

*Primary Examiner*—P. W. Echols
*Assistant Examiner*—Joseph M. Gorski

[57] ABSTRACT

A wood chipper to be lifted, transported and powered by a tractor having a power take-off at its rear, has forward and rearward housings. A chipping unit, located in the forward housing, is mounted on a driven shaft extending into the rearward housing and there provided with a pulley connected by a belt to a pulley on a drive shaft rotatably supported at one end by the rearward housing. The drive shaft extends below the first housing and is connectable to the power take-off of the tractor. The chipping unit has a forward square load-carrying member to which a circular, rearward blade carrying member is connected through impellers by which chips cut by blades are discharged.

10 Claims, 5 Drawing Sheets

8
14
71
68
74
15
69
18
70
70B
19
20
42
24
21
22
31
57
35
58
50
74
70A
26
59
61
37
65
51
71
11
8
27
32
28
28
29
25
29

81
74
71
15
14
68
70
70B
84
85
75
19
75
83
46
9
9
69
70A
71
74

WOOD CHIPPER TO BE TRANSPORTED AND POWERED BY A TRACTOR

BACKGROUND OF THE INVENTION

Wood chippers are available for use with tractors having power takeoff shafts at their rears and which are capable of lifting the chippers and transporting them to a site where, when lowered onto the ground, they may be connected to the power takeoff shafts of the tractors.

Such chippers are of two types. In one type, the chipping units are coupled directly to the power takeoff shafts. This type of chipper has the disadvantageous feature that the rate of rotation of the chipping unit is limited to the R.P.M. of the shaft.

The other type of wood chipper employs a belt drive to enable the RPM of the chipping unit to be substantially increased thus enabling it to store more energy. In such chippers, the belted drive unit is interposed between the tractor and the chipping unit.

The weight of a wood chipper is an important factor as, in general, the capabilities of a wood chipper increase with its weight. Assuming the ability of a farm tractor such as a Ford 8N or a John Deere 1050 to lift a wood chipper, the weight transferred from the front to the rear wheels may cause the tractor to be difficult to control and increase the risk of tipping over on rough ground or on a steep grade. Larger, more powerful tractors are similarly prevented from carrying chippers large enough to allow efficient commercial whole tree chipping to be done.

THE PRESENT INVENTION

The present invention recognizes that, with wood chippers employing belt drives for the chipping units, the problem is essentially one of weight distribution. The general objective of the invention is, accordingly, that of providing wood chippers of a weight previously unsuitable for use with a particular tractor to be adapted for safe and efficient use.

In accordance with the invention, this objective is attained by providing a wood chipper with a forward housing which is proximate to the tractor when connected thereto and a rearward housing. The chipping unit is located in the forward housing and it and its housing constitute by far the greater portion of the weight of the wood chipper. With the forward housing close to the tractor and with the lifting hitch of the tractor connected to the wood chipper directly below the forward housing, not only is the lifting ability of the tractor enhanced but also an adequate weight on the front end of the tractor is maintained. A driven shaft extends through the forward housing, where it carries the chipping unit, and into the rearward housing where it is equipped with a pulley connected by a belt to a pulley on the chipper drive shaft. The chipper drive shaft is rotatably supported by the rearward housing in a position below the forward housing which is positioned so that the drive shaft is readily accessible for connection to the power takeoff shaft of the tractor.

With the positioning of the relatively heavy chipping unit and housing forwardly to minimize or eliminate the mechanical advantage which that component has previously had, chipper weights which were previously objectionable can now be safely used. With the positioning of the belt drive housing at the rear of the chipper, the use of a relatively long universal joined coupling with the takeoff shaft of the tractor is possible allowing a wide range of motion of the chipper relative to the tractor without producing excessive angularity of the universal joints. The belt drive not only serves to provide a wanted increase in the RPM of the chipping unit but also enables power transmission to bypass the bulk of the forward housing.

Another objective of the invention is to increase the efficiency of the chipping unit. This objective is attained with a unit which has a forward square member to which a rearward circular member is connected by chip impellers which also serve as spacers. The circular member consists of two segments so held by the spacers that the segments are concentric with a gap between them divided into two radial gaps by the driven shaft which are bordered along their leading edges by the impellers extending substantially the full length of the two gaps. Blades border the other edges of the gaps.

Such a chipping unit has several advantages as it enables full length chipping blades to be used with the square member capable of throwing chips and acting as a fan. In addition with the use of bolt holes for use in securing the impellors and the segments of the square member in a radial pattern from the shaft receiving bore to the corners. The strength of the square member is affected thereby to a much lesser extent than would be the case with a circular member.

It is advantageous for the chipping unit to be as large and heavy as practicable as the greater the radius of the circular disc, the longer and heavier the knives that can be used. The heavier the chipping unit, the more energy it can store and the less the jar and vibration attendant the operation of the chipper.

Other objectives and the manner of their attainment will be apparent from the following description of a preferred embodiment and the appended claims.

BRIEF DESCRIPTION OF THE DRAWINGS

The accompanying drawings illustrate a preferred embodiment of the invention of which

THE PREFERRED EMBODIMENT OF THE INVENTION

A wood chipper in accordance with the invention is adapted for use with a tractor 10 having a power takeoff shaft 11 and lifting arms 12 and 13. As such tractors and their functions are well known, the tractor 10 is not further described.

Figure 7:
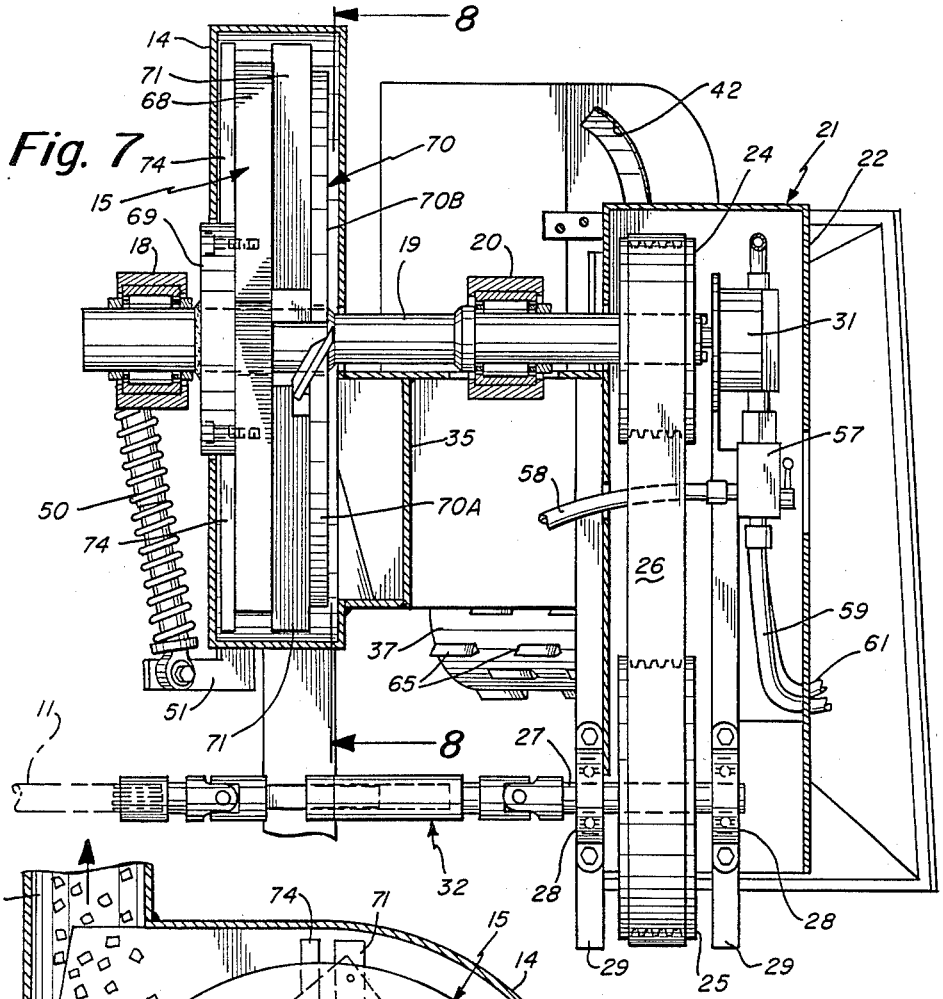
FIG. 7 is a section on an increase in scale taken approximately along the indicated line 7—7 of FIG. 2.
Figure 8:
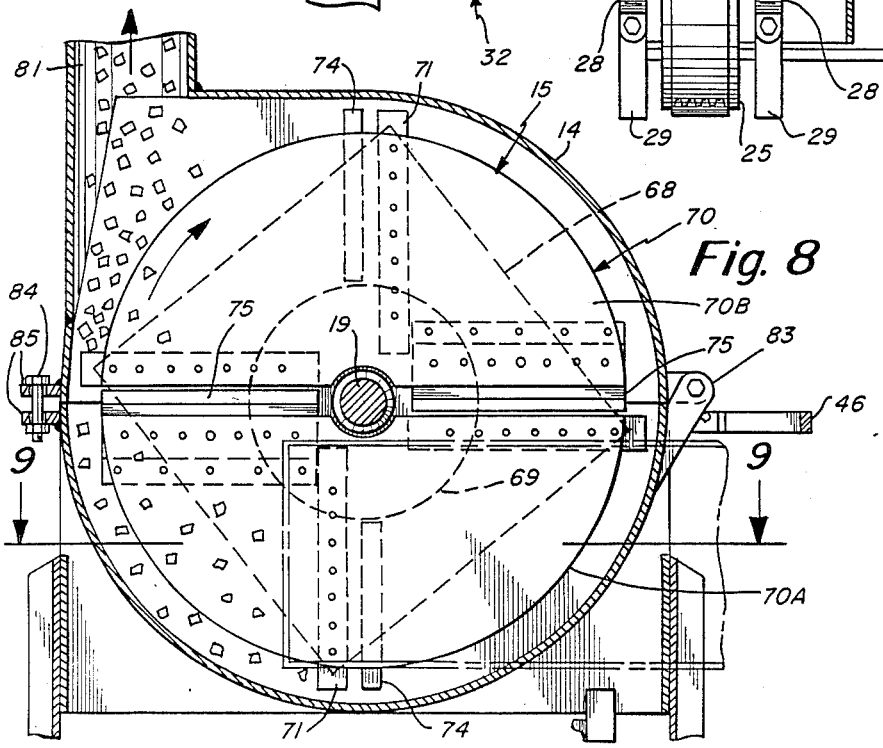
FIG. 8 is a section taken along the indicated line 8—8 of FIG. 7.

The housing 14 contains the wood chipping unit, generally indicated at 15 in FIGS. 7 and 8, and is supported by the legs of a stand 16. Mounted on the front side of the housing 14, the side adjacent the tractor 10 when positioned to be powered thereby, is a bracket 17 on which is mounted a bearing 18 for one end of the shaft 19 which extends through the housing 14 with the wood chipping unit 15 mounted thereon and through a bearing 20 and into a housing 21 provided with a removable cover 22. The housing 21 and the bearing 20 are supported by a mount 23 attached to the other or back side of the housing 14.

Figure 2:
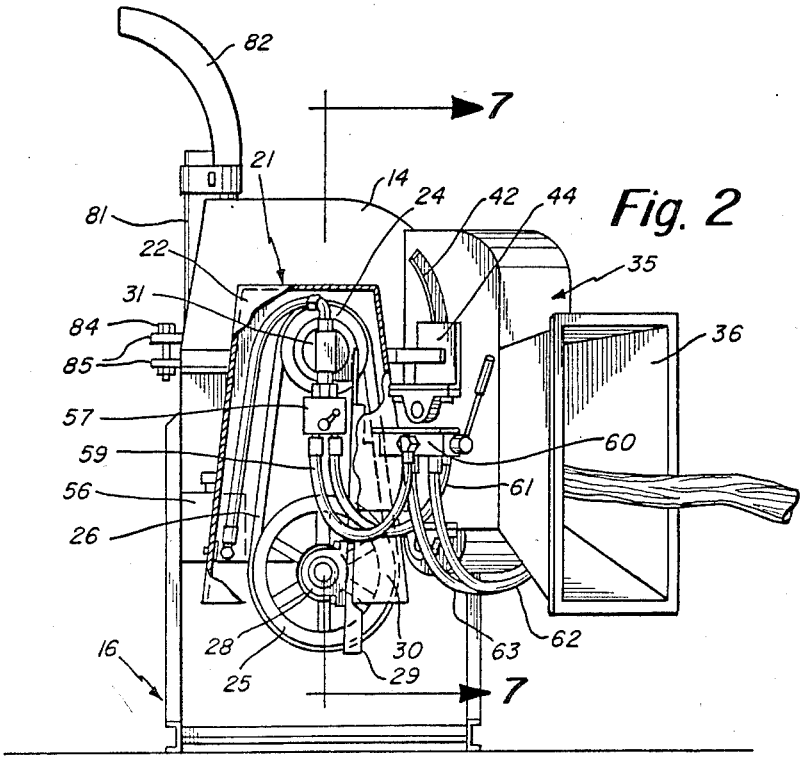
FIG. 2 is a view of the chipper as seen from the rear.
Figure 3:
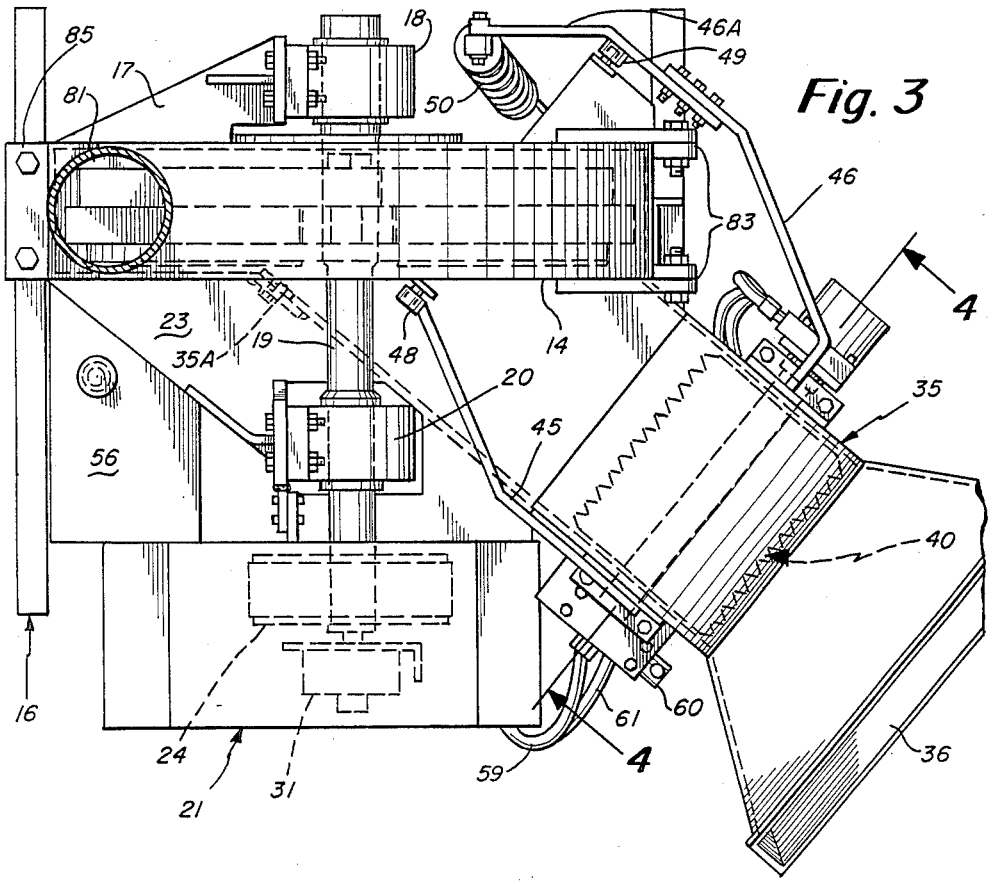
FIG. 3 is a section, on an increase in scale, taken approximately along the indicated line 3—3 of FIG. 1.

Within the housing 21, see FIGS. 2 and 7, there is a pulley 24 fixed on the end of the shaft 19 about which and a pulley 25 adjacent the open bottom of the housing 21 a belt is trained. The pulley 25 is fast on a stub shaft 27 journalled in bearings 28 fixed on angle irons 29. One angle iron 29 is welded to the front wall of the housing 21 while the other angle iron 29 is welded to a support 30 secured to one of the walls of the housing 21. The housing of a hydraulic pump 31 is attached to the upper end of the last named angle iron and is connected to the free end of the shaft 19 to be driven thereby.

Figure 1:
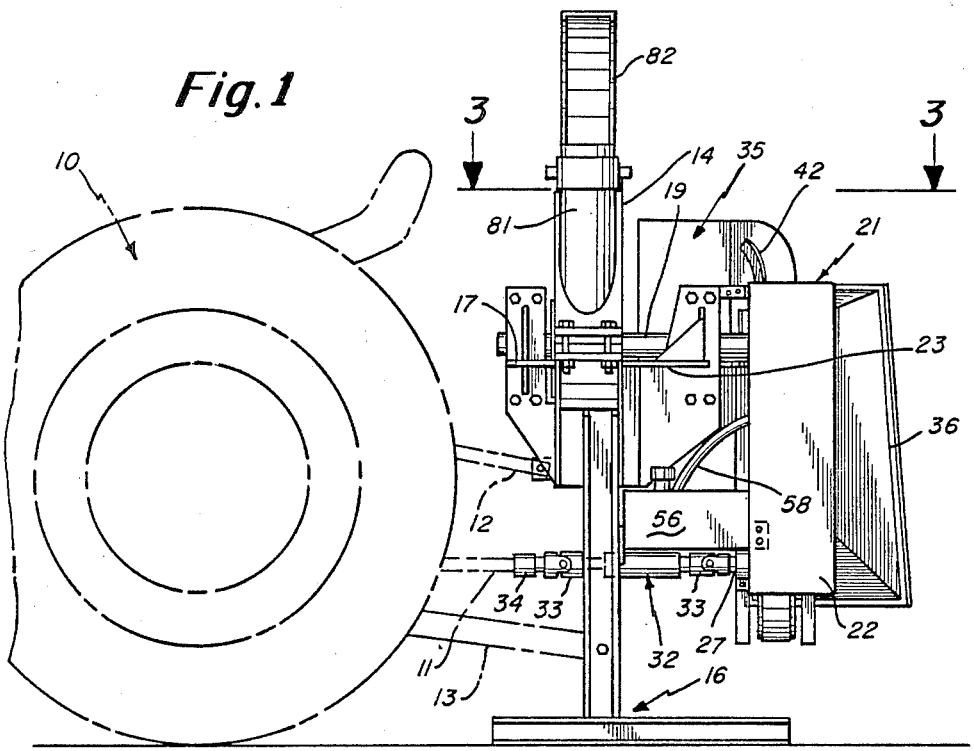
FIG. 1 is a side view of the chipper.

A generally indicated power shaft 32, see FIG. 1, is connected by a universal joint 33 to the power take-off shaft 11 of the tractor through a splined connector 34 and by a like universal joint 33 to the stub shaft 27. The power shaft 32 consists of telescoping sections 32A and 32B. The section 32A is square in cross section and is a slidable fit in the square passageway through an adaptor 32C which is welded on the end of the section 32B which is or may be a length of pipe. When the wood chipper has been carried by the tractor to a working location and lowered to be supported by the ground, the power shaft 32 connected to the power take-off of the tractor, both the hydraulic pump 31 and the wood chipping unit 15 are ready to operate. As previously noted, with the belt drive housing 21 at the rear of the chipper, the power shaft 32 is of substantial length and allows a wide range of motion of the chipper relative to the tractor without producing excessive angularity of the universal joint 33.

Before detailing the wood chipping unit 15, the means by which wood is fed thereto will be described. A feed chute 35 has a funnel shapped entrance 36 to facilitate the introduction of small logs, sticks and branches into the chipping unit 15. The chute 35 opens at an acute angle into the lower part of the back of the housing 14 and at the junction there is a removable wear plate 35A and has a lower feed roller 37 the position of which is fixed by bearings 38 mounted on the side walls of the chute 35 in support of its shaft 39. An upper feed roller 40 is mounted on a shaft 41 which extends through arcuate slots 42 in the side walls of the chute 35 with its ends held by bearings 43. Each bearing 43 is connected by mounts 44 to the appropriate one of the side arms 45 and 46 of a holder 47 extending through the slots 42 above the roller 40. The arm 45 is pivotally connected as at 48 to the back side of the housing 14 and the arm 46 is pivotally connected to a bracket 49 on the front side thereof with a free end 46A pivotally connected to a shock absorber 50 pivotally connected to a bracket 51 welded to the housing 14 and yieldably opposing upward movement of the upper feed roller 40.

The forwardly extending ends of the shafts 39 and 41 are connected to hydraulic motors 52 and 53, respectively, with the casing of the motor 52 held by a bracket 54 mounted on the front side of the feed chute 35. The casing of the motor 53 is carried by a bracket 55 on the arm 46.

The feed rollers 37 and 40 are driven by fluid under pressure delivered to the hydraulic motors 52 and 53, respectively. For that purpose, the intake of the pump 31 is connected to the reservoir 56 and its discharge is connected to the flow control valve 57. The valve 57 has a return line 58 in communication with the reservoir 56 and a delivery line 59 connected to a direction control valve 60 which has a return line 61 connected through the valve 57 to the return line 58. Lines 62 and 63 from the valve 60 are connected to the hydraulic motors 52 and 53, respectively, and a line 64 connects the two motors whereby, depending on the setting of the valve 60, the rollers 37 and 40 are rotated either in a direction feeding the material to be chipped into the chipper housing 14 or in the reverse direction. It will be appreciated that the flow control valve 57, in enabling the volume of oil under pressure delivered to the direction control valve 60 to be adjusted, enables the rate of rotation of the feed rollers to be varied under some operating conditions. The rate at which material is fed into the chipper housing 14 must be regulated to ensure maximum production without generating excessive heat due to friction.

Figure 4:
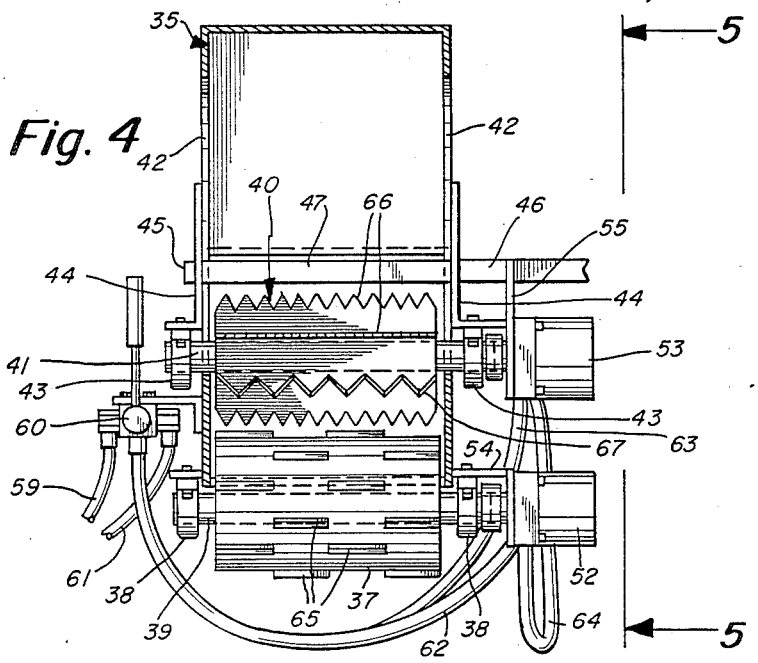
FIG. 4 is a section taken approximately along the indicated 4—4 of FIG. 3.
Figure 5:
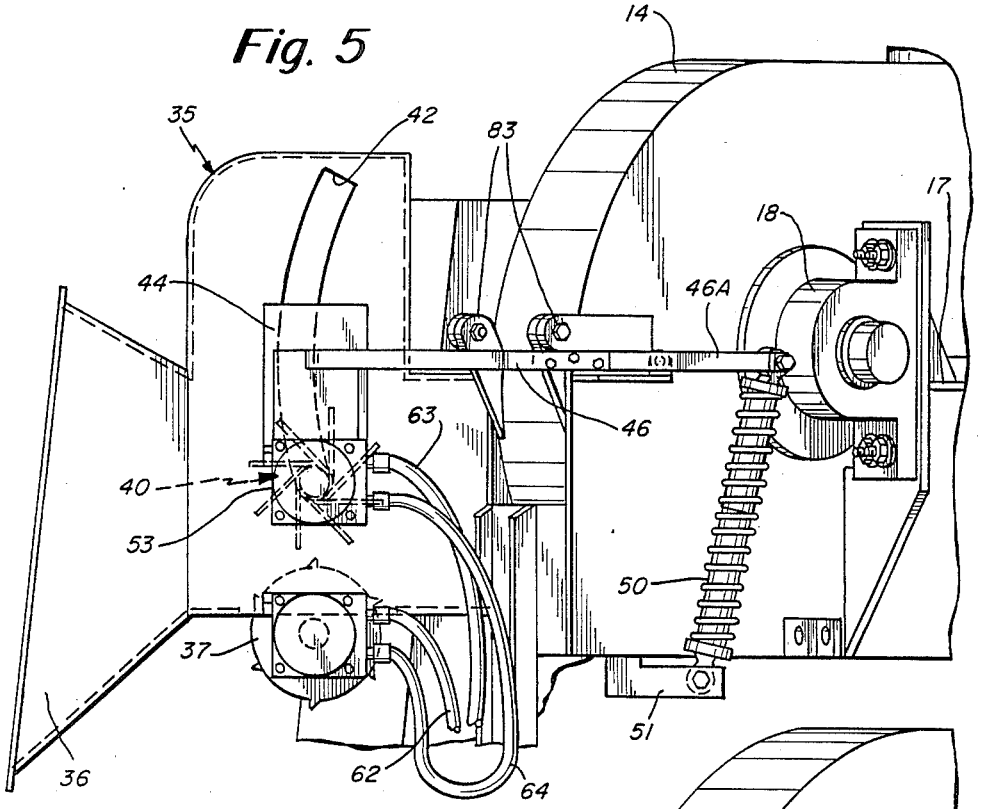
FIG. 5 is a view taken approximately along the indicated line 5—5 of FIG. 4.
Figure 6:
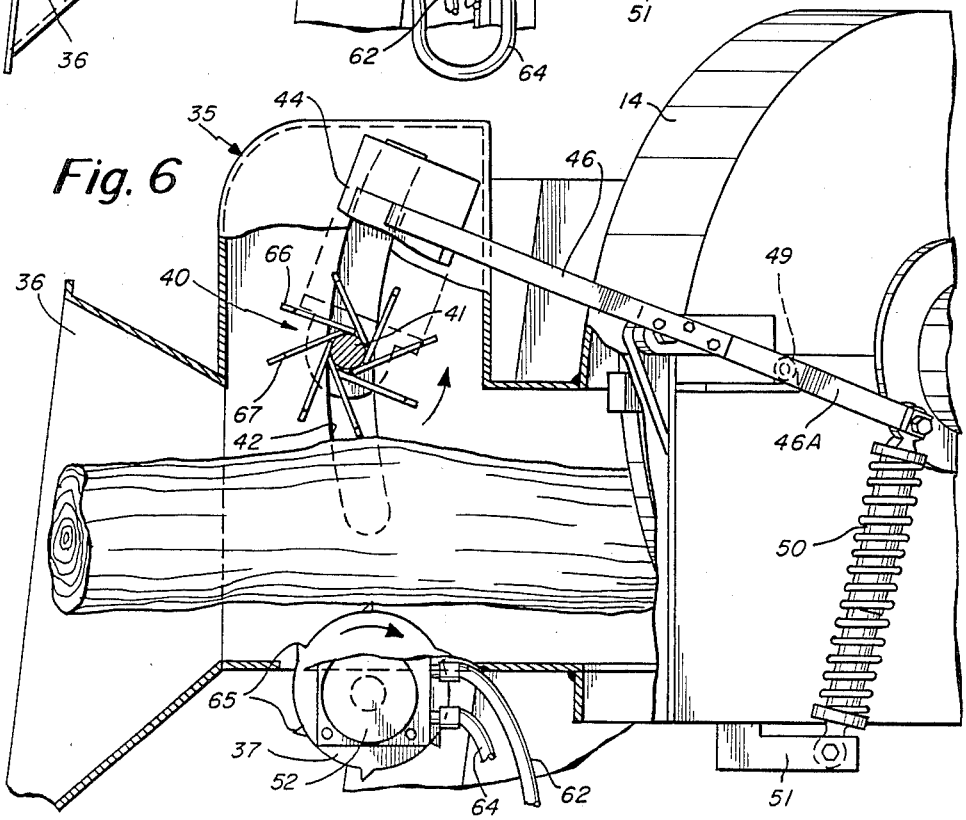
FIG. 6 is a view similar to FIG. 5 but with the side wall of the feed housing broken away to show the feed rolls and the connection of the upper feed roll to the shock absorber.

The feed roller 37, see FIG. 4, is provided with circumferentially spaced series of short gripping bars 65 extending lengthwise thereof with the bars of each series spaced apart and offset with respect to bars of adjacent series. 18. The feed roller 40 is provided with two circumferentially spaced and attending series of serrated blades 66 and 67 with the teeth of the blades 67 coarser than those of the blades 66.

Figure 9:
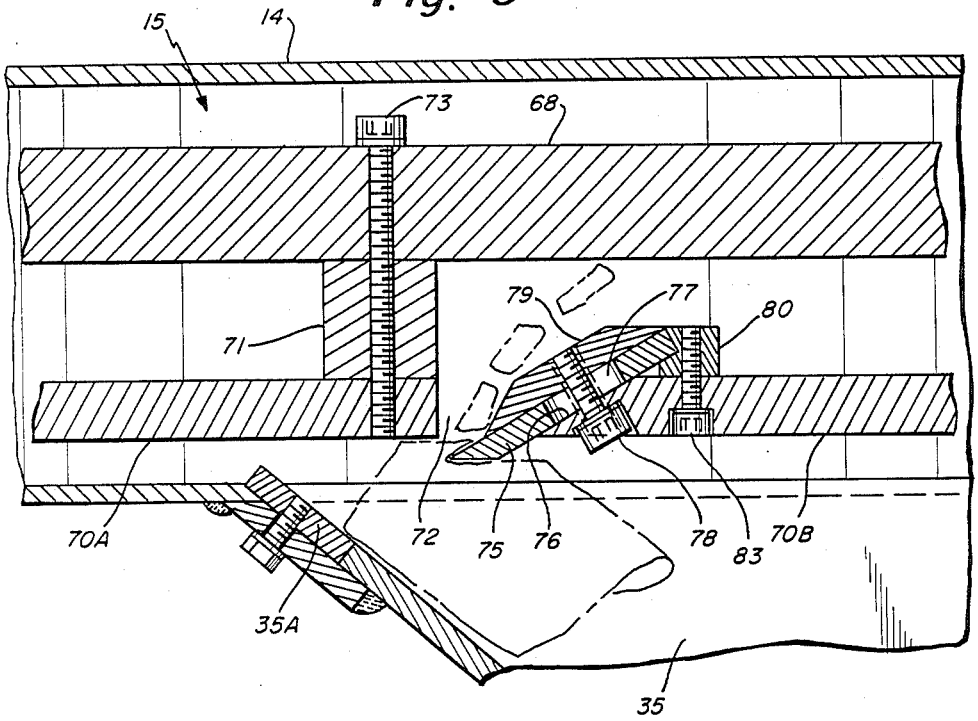
FIG. 9 is a view on a further increase in scale, taken approximately along the indicated line 9—9 of FIG. 8.

The wood chipping unit 15, see FIGS. 7–9, consists of a square load carrying plate 68 to the front of which a hub 69 is bolted and which is welded to the shaft 19. The blade carrying plate 70 consists of two identical arcuate sections 70A and 70B which are close to but less than 180° in extent. The sections 70A and 70B, when connected to the back of the plate 68 through spacing bars 71 then have the same radius and with gaps 72 between them. Each section 70A, 70B is anchored to the load carrying plate 68 by a series of bolts 73 which extend through the load carrying plate 68, a spacing bar 71 and are threaded into bores in the appropriate one of the blade carrying plate sections 70A, 70B. One spacing bar 71 is thus anchored to the trailing edge of each section 70A, 70B and it will be noted that each of the bars 71 is disposed at right angles to adjacent bars and all the bars are spaced circumferentially the same distance apart. Each series of bolts 73 extend to a corner of the load carying plate 68. The load carrying plate 68 is substantially thicker and accordingly heavier than the blade carrying plate 70. With the two plates detachably connected and each plate having a separate function, the unit 15 is well adapted to meet assembly use and service requirements.

It will be noted that the bars 71 extend beyond the periphery of the plate 70 and the corners of the plate 70 and serve as chip ejectors as do the two bars 74 which are secured to the front of the plate 68. Each bar 74 is parallel to and on the trailing side of the appropriate one of the two bars 71 which are positioned at right angles to the gaps 72.

The direction in which the chipping unit 15 turns is indicated by the arrow in FIG. 8. Bordering each gap 72 and extending along the full length of the leading edge thereof is a chipping blade 75. As may best be seen in FIG. 9, each blade is seated against the beveled surface 76 of the leading edge of the appropriate one of the sections 70A, 70B and has a series of lengthwise slots 77 of substantial width through each of which extends a cap screw 78 threaded into a clamping bar 79 between the beveled margins thereof. Each blade 75 is backed by a stop bar 80 locked to the appropriate one of the sections 70A, 70B by cap screws 78.

As wood is fed angularly against the exposed face of the rapidly revolving plate 70, it is chipped by the blades 75 with the chips entering the space between the plates 68 and 70 subjected to the centrifugal force exerted thereon. The chips are thus carried towards and into the vertical discharge port 81 then to be discharged laterally by the chute 82, see FIG. 2 which is rotatably connected to the port 81 so that the direction of chip discharge may be controlled.

It will be noted that the upper half section at one end of the housing 14 is hingedly connected to the lower half section at one end as at 83, see FIG. 8, while its other end is releasably locked to the lower half by bolts 84 extending through flanges 85, one secured to each section of the housing 14.

From the foregoing, both the construction of the chipper and is operation is apparent as well as the features which render chippers in accordance with the invention well adapted to meet production, use and service requirements

I claim:

1. A wood chipper adapted to be attached to the rear end of a tractor having a power takeoff shaft and lifting arms and transported by the tractor, said chipper including forward and rearward housings and a stand below the forward housing in support of both housings and to which said arms are connectable, the forward housing being proximate to the tractor when the chipper is connected thereto and provided with a chip discharge, a driven shaft extending through the forward housing and into the rearward housing, bearing units in support of the shaft on opposite sides of the forward housing, a chipping unit within the forward housing and fixed on said driven shaft and provided with chipping blades exposed on the rearward side thereof and with impellers operable to discharge chips through said discharge, a drive shaft connectable to the power takeoff shaft of the tractor extending below the forward housing and rotatably supported by the rearward housing a belt drive within the rearward housing connecting the drive and driven shafts, and a wood feed including a chute opening into the forward housing at an acute angle with respect to the rearward side of the chipping unit with its infeed end close to but lateral of the rearward unit, said wood feed including a pair of feed rollers, means enabling one roller to move towards or away from the other roller, and an hydraulic drive for each roller, said drive including a pump driven by one of said belt connected shafts.

2. The wood chipper of claim 1 in which the forward housing is connected to the stand, and structure secured to the rear of the forward housing supports the rearward housing and includes the discharge end of the wood feed.

3. The wood chipper of claim 1 in which the chipping unit consists of a rearward circular member, a forward square load-carrying member, impellers connect the members, the circular member has a pair of transversely aligned gaps, there is one chipping blade for each gap mounted lengthwise thereof to discharge removed chips into the spaces between the two members and the impellers.

4. The wood chipper of claim 3 in which the circular member consists of two arcuate segments so dimensioned and connected to the square member as to become circular with transversely aligned, radial gaps between them divided by the driven shaft, an impeller borders the trailing margin of each segment and a blade is attached to the leading margin of each segment and extends from close to the driven shaft to the periphery of the circular member.

5. The wood chipper of claim 4 in which there are two additional impellers disposed at right angles relative to the gaps and spaced apart equal distances from the impellers bordering the gaps.

6. The wood chipper of claim 5 in which the impellers protrude beyond the periphery of the circular member and a series of impellers are attached to the front surface of the square member adjacent the corners thereof and protrude to have a path beyond the path of the corners thereof.

7. The wood chipper of claim 6 in which the gap at each side of the drive shaft is close to but on the trailing side of opposite corners of the square member.

8. The wood chipper of claim 3 in which the thickness of the square member is approximately twice that of the circular member and the distance between opposite corners is approximately equal to the diameter of the circular member.

9. The wood chipper of claim 1 in which the means enabling one roller to move forwards and away from the other includes a shock absorber yieldably opposing and cushioning such movements.

10. The wood chipper of claim 1 in which the stand and the forward housing are so positioned relative to each other that the weight center of the chipping unit is substantially in a vertical, transverse plane inclusive of the position of the ends of the arms when connected to the stand.

* * * * *